US008912732B2

(12) United States Patent
Hariharan

(10) Patent No.: US 8,912,732 B2
(45) Date of Patent: Dec. 16, 2014

(54) CURRENT SENSING FOR LED DRIVERS

(75) Inventor: Suresh Hariharan, Livermore, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 604 days.

(21) Appl. No.: 13/157,598

(22) Filed: Jun. 10, 2011

(65) Prior Publication Data

US 2011/0304276 A1 Dec. 15, 2011

Related U.S. Application Data

(60) Provisional application No. 61/353,547, filed on Jun. 10, 2010.

(51) Int. Cl.
*H05B 37/02* (2006.01)
*H05B 33/08* (2006.01)

(52) U.S. Cl.
CPC ..... *H05B 33/0815* (2013.01)
USPC ..... 315/250; 315/297

(58) Field of Classification Search
CPC ..... H05B 37/02; H05B 37/00
USPC ..... 315/250, 209 R, 291, 294, 297, 307, 312
See application file for complete search history.

(56) References Cited

U.S. PATENT DOCUMENTS

| | | | | |
|---|---|---|---|---|
| 2005/0243041 | A1 | 11/2005 | Vinn | |
| 2007/0104075 | A1 | 5/2007 | Shaanan et al. | |
| 2007/0228999 | A1* | 10/2007 | Kit | 315/291 |
| 2008/0316781 | A1* | 12/2008 | Liu | 363/80 |
| 2009/0072755 | A1* | 3/2009 | Prexl et al. | 315/291 |
| 2009/0230891 | A1* | 9/2009 | Zhao et al. | 315/308 |
| 2010/0013409 | A1* | 1/2010 | Quek et al. | 315/294 |

FOREIGN PATENT DOCUMENTS

WO WO2009/138104 A1 11/2009

OTHER PUBLICATIONS

PCT Search Report and Written Opinion, received for co-pending PCT application PCT/US2011/039950; mailed on Aug. 17, 2011.

* cited by examiner

*Primary Examiner* — Tung X Le
*Assistant Examiner* — Jonathan Cooper
(74) *Attorney, Agent, or Firm* — North Weber & Baugh LLP

(57) ABSTRACT

Embodiments of the present invention provide a system and method for determining a magnitude of current driving LEDs by sensing a current through a switching transistor and extracting the information of the LED current based on a relationship between the current through the switching transistor and the current driving the LEDs.

20 Claims, 4 Drawing Sheets

LED string comprising of one or more LEDs
220
LED-
LED+
C1
222
D1
320
L1
Input voltage
210
Ileds
280
270
I2
I1
260
A
Q1
235
230
LED Driver
ISENSE
GND
Rsense
240
Q2
245
R2
246
C2
249
Unity Gain buffer
250
D2
310
D3
290
B
330
C
Ileds

CURRENT SENSING FOR LED DRIVERS

CROSS REFERENCE TO RELATED PATENT APPLICATIONS

This application claims priority to U.S. Provisional Application Ser. No. 61/353,547, entitled "Current Sensing for LED Drivers," filed Jun. 10, 2010, which application is incorporated herein by reference in its entirety.

BACKGROUND

1. Field of the Invention

The present invention relates to power conversion, and corresponding devices and systems, that senses current and adjusts a regulated current being delivered to a load. More particularly, certain embodiments of the present invention relate to power conversion within a light emitting diode (hereinafter, "LED") system that senses relatively low current on a switch/sense node and relates this sensed current to the amount of regulated high current being delivered to an LED string(s).

2. Background of the Invention

The benefits and wide-range applicability of LEDs in today's lighting systems are now realized and recognized by those skilled in the art. For many years, halogen-based lamps were the primary light source implemented within lighting systems. Over the past years as LED technology has developed, the advantages of LEDs over halogen lamps have become increasingly apparent. When compared to halogen lamps, LEDs are relatively smaller, and have a longer operating life. Another important difference between halogen bulbs and LEDs is the significantly less amount of power required by LEDs to operate. For example, a halogen lamp may operate within a range of 20-50 Watts and an LED at about 5-15 Watts.

When LEDs are used for lighting applications, a cluster or an array of LEDs is used to achieve the requisite brightness and other desired lighting characteristics. Regardless of color, type, color, size or power, all LEDs work the best when driven with a constant current. LED manufacturers specify the characteristics (such as lumens, beam pattern, color) of their devices at a specified current value. One or more LED drivers are used to effectively control the electrical characteristics of the array of LEDs to suit the lighting. A LED driver is a self-contained power supply that has outputs matched to the electrical characteristics of the array of LEDs. Most LED drivers are designed to provide constant currents to operate the array of LEDs.

Many LED lamps are powered in the same way as other lighting applications, namely, starting with and using an alternating current (AC) power source. Depending on the geographic location or application, the AC source could range between 100V and 240V. The frequency of these AC sources ranges between 50 Hertz and 60 Hertz. To meet energy star requirements for LED lighting applications, the required power factor has to be greater than 0.9. This can be achieved by a passive or active power factor correction circuit.

In applications where the power levels are higher than 25 Watts, an active power factor correction circuit is typically used to provide a regulated high voltage DC bus. This regulated bus is used to power the LEDs by a power conversion circuit. This power conversion circuit may be an isolated topology or non-isolated topology.

Several LED lighting applications that operate within high voltage DC or AC ranges require that the current delivered to the LED be measured. In many applications, the LED is at a high voltage and sensing the LED current requires relatively expensive high-side current sense amplifiers or current sense transformers to measure the current flowing into the LEDs. This sensed information is subsequently sent to the control side of the driver so that the regulated current may be adjusted if appropriate. In applications where the LEDs are positioned within an isolated topology, optical couplers may be used to transfer the LED current information from the systems secondary side to the primary side.

This requirement in prior art systems to measure current on high current lines feeding into the LEDs and/or on lines isolated from the control side of the driver requires expensive sensing components within the system and possibly expensive optical couplers. What is needed is a system and method that eliminates high current sense components (e.g., high current sense amplifiers or transistors and optical couplers) within LED systems. This need is relevant in both non-isolated topologies as well as isolated topologies.

SUMMARY OF THE INVENTION

Embodiments of the present invention provide a system and method for determining a magnitude of current driving LEDs by sensing a current through a switching transistor and extracting the information of the LED current based on a relationship between the current through the switching transistor and the current driving the LEDs. The average current through the switching transistor is smaller than the current driving the LEDs, which obviates the need for expensive, high current sensing components being employed within the system. In addition for isolated topologies, the switching power device is on the same side of the isolation as the control circuit. For this reason, this invention eliminates the need for expensive optical couplers. These embodiments may be applied to both isolated and non-isolated topologies as well as different power architectures including buck, buck-boost, boost, fly-back, forward, full bridge and half bridge.

In certain embodiments, an LED system having current sense and regulation components is used. An AC power source provides an alternating current to an LED driver and current regulator. The LED driver and regulator convert the alternating current to a DC current and regulate its magnitude to a preferred value so that the LEDs receive an appropriate power.

The LED driver and regulator is controlled by a control block comprising at least one switching device that enables an alternating form of current at a particular frequency to be applied to the LED array regardless of whether the main power source is a DC or AC power source. The LED array comprises the solid state lighting device.

In various embodiments, the control block is configured so as to enable the current through the LED array to be determined without using a current sense on this high current line. Contrary to prior approaches, the LED driver does not measure any current in the LED array to regulate the solid state lighting application. Instead, the LED driver measures the current through a current sense on the low-current side of the lighting application.

In certain embodiments, the current sense comprises a switch and a sense node. When the switch is on, then current from the LED driver and regulator is diverted to a sense node which detects current through the switch. Using a relationship between the current through the switch and the current through the LED array, the current through the LED array is derived from the sensed current on the switch. This current is then provided to the control block so that proper regulation of the current through the LED array may be performed.

BRIEF DESCRIPTION OF THE DRAWINGS

Reference will be made to embodiments of the invention, examples of aspects of which may be illustrated in the accompanying figures. These figures are intended to be illustrative, not limiting. Although the invention is generally described in the context of these embodiments, it should be understood that the scope of the invention is not limited to the particular embodiments thereof disclosed herein.

DETAILED DESCRIPTION OF THE INVENTION

In the following description, for the purpose of explanation, specific details are set forth in order to provide an understanding of the invention. It will be apparent, however, to one skilled in the art that the invention may be practiced without selected of these details. One skilled in the art will recognize that embodiments of the present invention, some of which are described below, may advantageously be incorporated into a number of different devices and systems. Structures and devices shown in block diagram are illustrative of exemplary embodiments of the invention and are included to avoid obscuring the invention. Furthermore, connections between components within the figures are not intended to be limited to direct connections. Rather, such connections between components may be modified, reconfigured, or otherwise changed by intermediary components.

Reference herein to "one embodiment" or "an embodiment" of the invention means that a particular feature, structure, characteristic, or function described in connection with the embodiment is included in at least one embodiment of the invention. The use of the phrase "in one embodiment" at various locations in the specification are not necessarily all references to a single embodiment of the invention.

Embodiments of the present invention provide a system and method for determining a magnitude of current driving LEDs by sensing a current through a switching transistor and extracting the information of the LED current based on a relationship between the current through the switching transistor and the current driving the LEDs. The average current through the switching transistor is smaller than the current driving the LEDs, which obviates the need for expensive, high current sensing components being employed within the system. In addition for isolated topologies, the switching power device is on the same side of the isolation as the control circuit. For this reason, this invention eliminates the need for expensive optical couplers. These embodiments may be applied to both isolated and non-isolated topologies as well as different power architectures including buck, buck-boost, boost, fly-back, forward, full bridge and half bridge.

Figure 1:
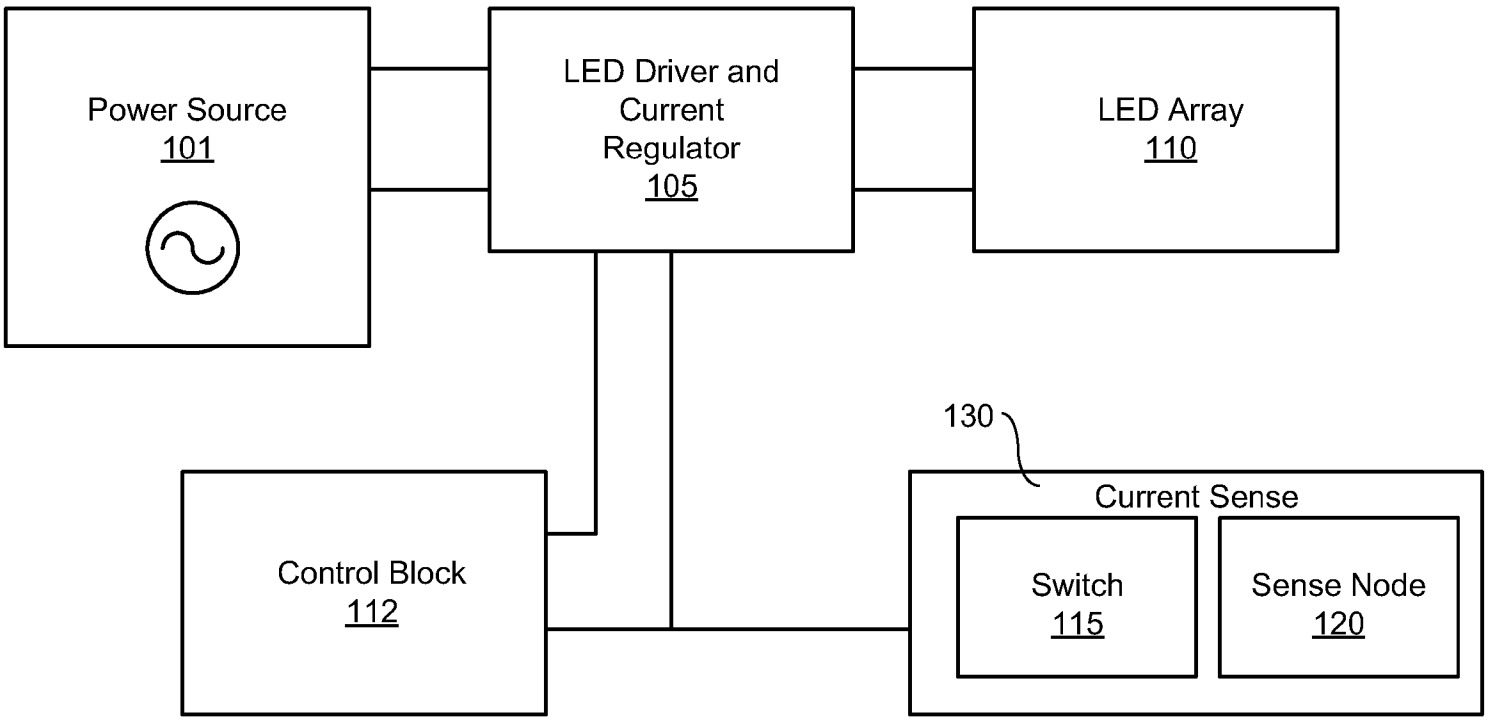
FIG. 1 illustrates an embodiment of an LED system, including an LED driver and current sense sub-component, according to various embodiments of the invention.

FIG. 1 generally illustrates an LED system having current sense and regulation components according to various embodiments of the invention. As shown, an AC power source 101 provides an alternating current to an LED driver and current regulator 105. These power sources can be implemented through several structures, each of which will be readily apparent to a person of skill in the art. The LED driver and regulator 105 converts the alternating current to a DC current and regulates its magnitude to a preferred value so that the LEDs receive an appropriate power.

The LED driver and regulator 105 is controlled by a control block 112. The driver 105 receives power from the power source 101. The control block 112 comprises electronic circuitry that enable the output current of the LED driver 105 to be controlled. This control block 112 comprises at least one switching device (not shown in FIG. 1) that enables an alternating form of current at a particular frequency to be applied to the LED array 110 regardless of whether the main power source 101 is a DC or AC power source. The functionality of the control block 112 and the various components within the control block 112 will be explained in further detail as it applies to additional embodiments discussed below.

The LED array 110 comprises the solid state lighting device. As the name suggests, the LED array 110 comprises an array or cluster of lighting emitting diodes (LEDs) arranged to provide the desired SSL structure. Examples of the LED devices include semiconductors LEDs, organic LEDs, polymer LEDs, etc. Other types of LEDs or other materials employed in SSL applications will be apparent to those skilled in the art, and any of these devices may be readily employed in the present invention.

In one embodiment shown in FIG. 1, the control block 112 is configured so as to enable the current through the LED array 110 to be determined without using a current sense on this high current line. Contrary to prior approaches, the LED driver 105 does not measure any current in the LED array 110 to regulate the solid state lighting application. Instead, the LED driver 105 measures the current through a current sense 130 on the low-current side of the lighting application. The current sense 130 comprises a switch 115 and a sense node 120. When the switch 115 is on, then current from the LED driver and regulator 105 is diverted to a sense node 120 which detects current through the switch 115. Using a relationship between the current through the switch 115 and the current through the LED array 110, the current through the LED array is derived from the sensed current on the switch 115. This current is then provided to the control block 112 so that proper regulation of the current through the LED array 110 may be performed. The relationship between the current on the switch 115 and the current through the LED array 110 will be described in more detail below.

The ability to effectively determine the magnitude of current through the LED array 110 by sensing a current on the low-side of the lighting system may be implemented in various system topologies. The following descriptions are intended to be exemplary of both isolated and non-isolated topologies, and one skilled in the art will recognize that various other topologies may support such a sensing method and architecture.

Figure 2:
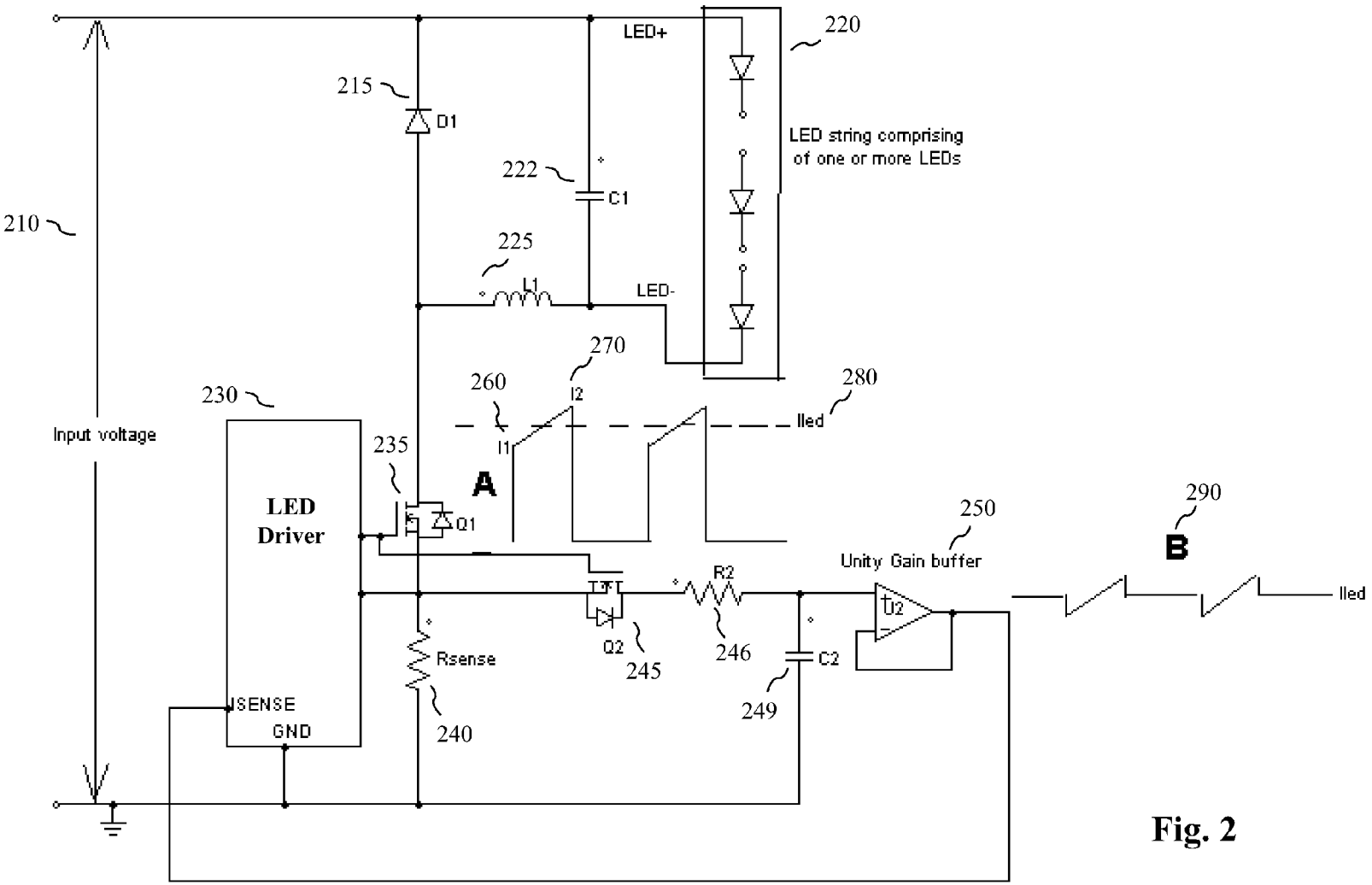
FIG. 2 is a block diagram illustrating a buck LED driver system according to various embodiments of the invention.

FIG. 2 is a block diagram illustrating a buck LED driver according to various embodiments of the invention. In this example, the system comprises a main power source 210 which is a DC power source. DC power source 210 provides power to an LED driver circuit 230. In certain embodiments, the LED driver is a pulse width modulated controller; however, one skilled in the art will recognize that various types of controllers may be employed with the present invention. Furthermore, it should be understood that this particular LED driver may be replaced with any other LED driver that can provide programmable current to the LED load.

An NDRV pin on the LED driver 230 is connected to a switching device 235, which may, for example, be a MOSFET. A pulsating voltage at a programmable fixed frequency from the LED drive 230 drives the switching device 235. This is, in turn, powered from the input voltage at the VIN pin of LED driver 230. The voltage across the resistor $R_{SENSE}$ 240 at the CS pin of LED driver 230 is used for a cycle by cycle current mode control function in LED driver 230. This sensed current signal is employed to control the switching of MOSFET 235.

When the switching MOSFET 235 is turned on, the current in the switch immediately rises to the current that was flowing through inductor 225 just before the switch 235 was turned on. The current on the switch 235 is illustrated $I_1$ 260 shown on plot A, which represents the current sense signal at the source of the switch 235. When the switching MOSFET 235 has turned off, the current in the inductor is represented by $I_2$ 270. This same current is seen on the current sense resistor $R_{sense}$ 240. When the switching MOSFET 235 turns off, the current in the sense resistor 240 goes to zero and stays at zero until the switching MOSFET 235 is turned on at the start of the next switching cycle.

The inductor 225 should be sized such that the current in the inductor 225 is continuous over the range of operation. The averaged current 280 in the inductor 225 is the current in the LED $I_{LED}$. In the case of the buck LED driver, the current in the LED is $I_{LED}$ being equal to $(I_1+I_2)/2$.

The system also comprises a circuit in which a signal, having a current significantly less than the current through the LED 220, can be measured and that is proportional to this current through the LED 220. This circuit comprises a second MOSFET switch 245, a second resistor 246, a second capacitor 247, and a unity gain buffer 250. In this example, the gate of the second switching MOSFET 245 is driven by the same signal that drives the power switching MOSFET 235. The second resistor 245 and second capacitor 247 form an RC filter. If the RC corner frequency is set sufficiently low, then the signal at the output of the unity gain buffer 250 may be related to the current through the LEDs 220. If the RC corner frequency is set sufficiently high then the signal at the output of the unity gain buffer will be related to the inductor current. In any case the average inductor current is equal to the average LED current. Plot B 290 illustrates an example of an output of the unity gain buffer 250. The output of the unity gain buffer 250 is directly proportional to the current through the LEDs 220 at lower frequencies, which is adequate for LED current regulation. In various embodiments of the invention, the output of the unity gain buffer 250 is fed back into the LED driver circuit 230 so that the LED current can be determined and current regulation can be performed.

One skilled in the art will recognize that the buck LED driver illustrated in FIG. 2 may be modified in accordance with various embodiments of the present invention.

Figure 3:
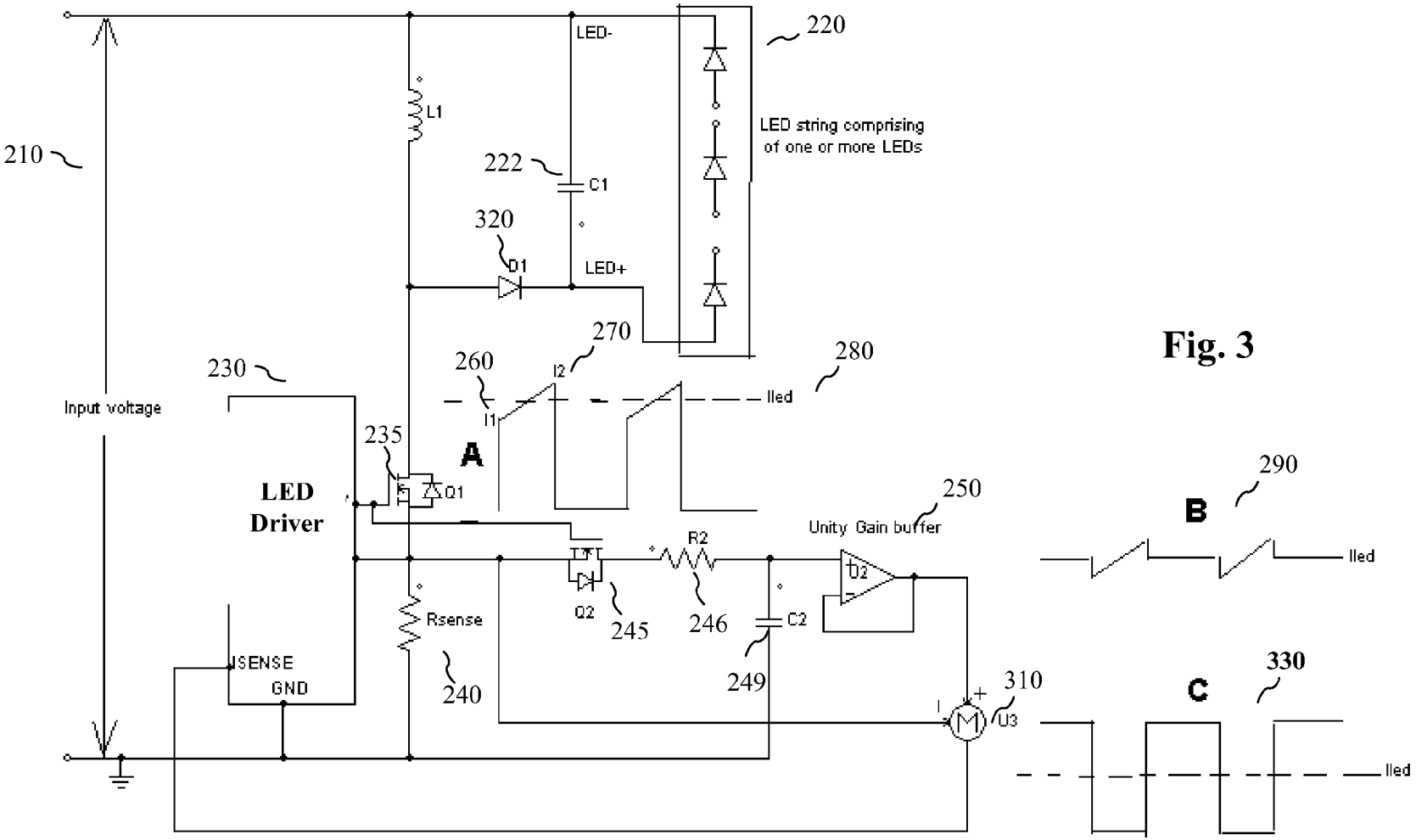
FIG. 3 is a block diagram illustrating a buck-boost LED driver system according to various embodiments of the invention.

FIG. 3 illustrates a buck-boost LED driver according to various embodiments of the invention. In this example, the output of the unity gain buffer 250 is compared, using comparator 310, to the current through the sense resistor 240. The difference between the output of the unity gain buffer 250 and the voltage across the sense resistor 240 is proportional to the current through diode 320. The averaged current in diode 320 is equal to or approximately equal to the current through the LED 220 at lower frequencies. Waveform C 330 represents the current through diode 320 at lower frequencies. Although the current through diode 320 at higher frequencies may not be represented by waveform 330, the lower frequency components is sufficient to allow for sufficient estimation of current through the LED 220 and regulation of this current.

Figure 4:
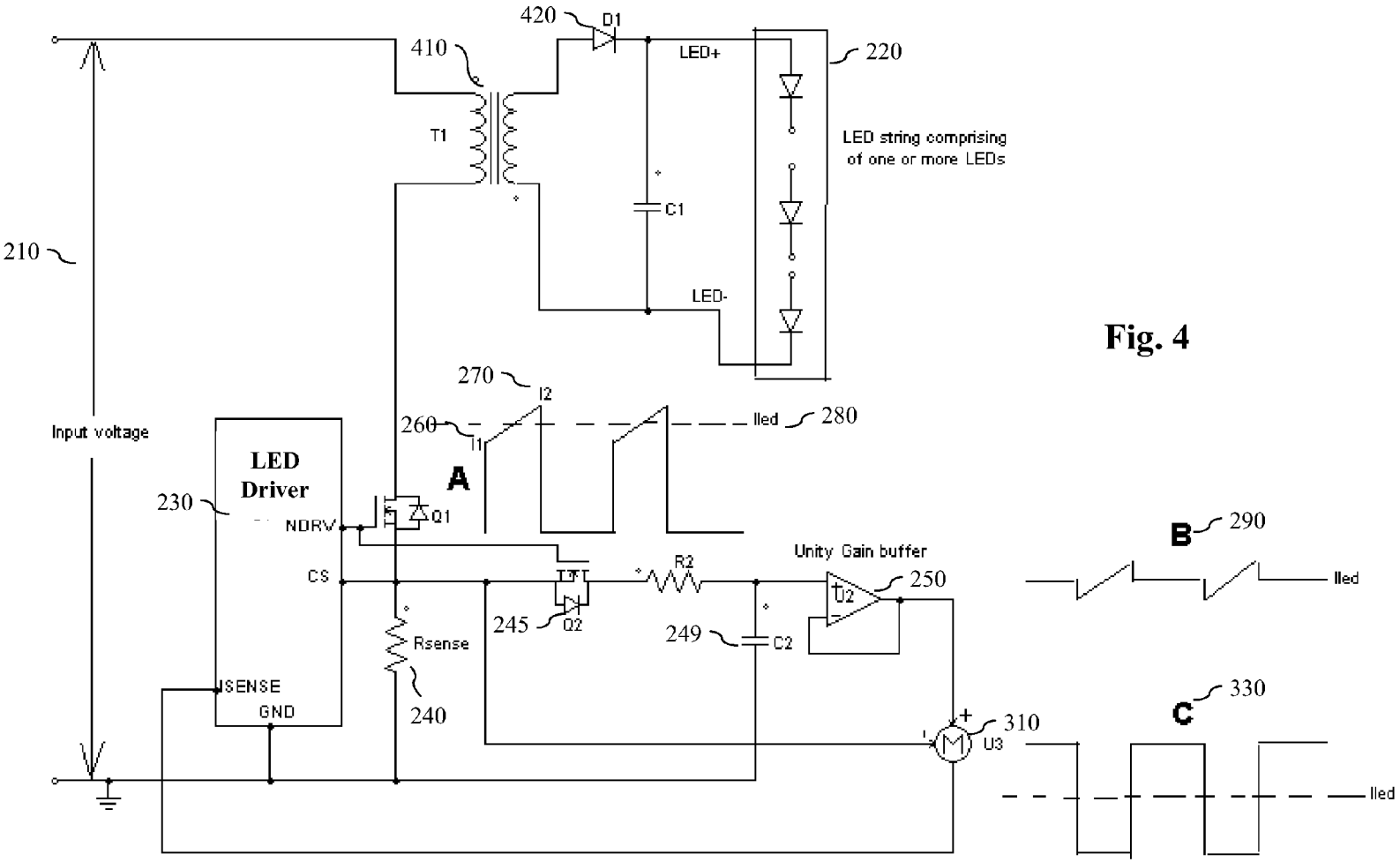
FIG. 4 is a block diagram illustrating a flyback LED driver system according to various embodiments of the invention.

FIG. 4 illustrates a flyback LED driver according to various embodiments of the invention. In this example, current is delivered from the input voltage 210 to the LED 220 through a transformer 410. The transformer causes a current to flow throw a diode 420 and into the LED string 220. Similar to the buck-boost topology, the difference between the output of the unity gain buffer 250 and the voltage across the sense resistor 240 is proportional to the current through diode 420. However, the characteristics of the transformer 410, and in particular the turn ratio of the transformer 410, are also factors in this proportional relationship. The averaged current in diode 420 relates to the current through the LED 220 at lower frequencies. Once again, waveform C 330 is proportionally representative of the current through diode 420 at lower frequencies such that the turn ratio of the transformer 410 is a factor in this relationship. Although the current through diode 420 at higher frequencies may not be representative by waveform 330, the lower frequency components is sufficient to allow for sufficient estimation of current through the LED 220 and regulation of this current.

One skilled in the art will recognize that other components and functionality may be inserted within the specific examples shown in the figures. Additionally, these examples may be modified to handle different power characteristics of LEDs, LED strings as well as electronic transformers and dimmers.

It will be appreciated to those skilled in the art that the preceding examples and embodiments are exemplary and are for purposes of clarity and understanding and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention. It is, therefore, intended that the following appended claims include all such modifications, permutation and equivalents as fall within the true spirit and scope of the present invention.

I claim:

1. An LED driving apparatus comprising:

an LED driver and regulator coupled to receive an input power signal from a power source, the LED driver and regulator converts the input power signal into a regulated current signal for an LED array;

a current sense circuit coupled to the LED driver and regulator, the current sense circuit comprises:

a first switch that receives a first current from a low-current side of the LED array; and a second switch coupled to the first switch, the second switch carries a second current representative of but relatively smaller than the first current, the current sense circuit generates a control signal based on the second current; and a control block coupled to the LED driver and regulator and the current sense circuit, the control block receives the control signal and controls the regulated current signal based at least in part on the control signal.

2. The LED driving apparatus of claim 1 wherein the second switch diverts the first current to a sense node within the current sense circuit, the sense node having a voltage that is proportional to an LED current.

3. The LED driving apparatus of claim 2 wherein the sense node is a resistor and the second switch is a MOSFET transistor.

4. The LED driving apparatus of claim 2 further comprising a unity gain buffer, the unity gain buffer outputs the control signal.

5. The LED driving apparatus of claim 1 further comprising an inductor, coupled between the LED driver and regulator and the LED array, the inductor averages a regulated current into the LED array.

6. The LED driving apparatus of claim 1 wherein the current sense circuit and the LED driver and regulator are integrated on a single substrate.

7. The LED driving apparatus of claim 1 wherein the LED driver and regulator is a buck architecture.

8. The LED driving apparatus of claim 1 wherein the LED driver and regulator is a buck-boost architecture.

9. The LED driving apparatus of claim 1 wherein the LED driver and regulator is a fly-back architecture.

10. An LED system comprising:

an interface on which a power signal is received;

an LED driver and regulator coupled to the interface and that converts the power signal into a regulated current signal;

an LED array coupled to the LED driver and regulator, the LED array comprising a plurality of LEDs;

a current sense circuit coupled to the LED driver and regulator, the current sense circuit comprises:

a first switch that receives a first current from a low-current side of the LED array; and a second switch coupled to the first switch, the second switch carries a second current representative of but relatively smaller than the first current, the current sense circuit generates a control signal based on the second current; and a control block coupled to the LED driver and regulator and the current sense circuit, the control block receives the control signal and controls regulates the regulated current signal based at least in part on the control signal.

11. The system of claim 10 wherein the power signal is received from a DC source.

12. The system of claim 10 wherein the power signal is received from an AC source.

13. The system of claim 10 wherein the LED system is a retrofitted halogen-based system in which the LED driver and regulator, the current sense circuit, and the control block are implemented.

14. A method for regulating a current signal driving an LED array, the method comprising:

receiving an input current from a current source;

regulating the input current to generate a first current, the first current drives an LED array;

sensing a second current at a low-current side of the LED array, the second current having a relationship to the first current;

calculating a value of the first current based on a feedback signal derived from of the second current; and adjusting the regulated first current so that a power delivered to the LED array falls within a preferred power range.

15. The method of claim 14 wherein the preferred power range is between 5 and 15 Watts.

16. The method of claim 14 wherein the LED array comprises at least one LED selected from a group consisting of a semiconductor LED, an organic LED, and a polymer LED.

17. The method of claim 14 wherein the second current at the low-current side of the LED array is sensed by diverting a first portion of a low-side current to a sense node.

18. The method of claim 14 wherein a unity gain buffer is used to relate second current to the first current.

19. The method of claim 14 wherein the step of generating the first current is performed in a topology selected from a group consisting of a buck topology, a boost topology, a buck-boost topology, a forward topology, a half-bridge topology and a full-bridge topology.

20. The method of claim 14 wherein an inductor is used to average the first current over a preferred range of operation.

* * * * *